US007156330B1

(12) United States Patent
Lo

(10) Patent No.: US 7,156,330 B1
(45) Date of Patent: Jan. 2, 2007

(54) PAPER SHREDDER DELAYING DEVICE

(76) Inventor: Emily Lo, No. 18, Lane 20, Hsin Feng Street, Hsin Chuang City, Taipei Shien (TW)

( * ) Notice: Subject to any disclaimer, the term of this patent is extended or adjusted under 35 U.S.C. 154(b) by 0 days.

(21) Appl. No.: 11/312,047

(22) Filed: Dec. 19, 2005

(51) Int. Cl.
*B02C 23/00* (2006.01)

(52) U.S. Cl. ..... 241/36; 241/100

(58) Field of Classification Search ..... 241/100, 241/236, 295, 33, 36
See application file for complete search history.

(56) References Cited

U.S. PATENT DOCUMENTS 5,167,374 A * 12/1992 Strohmeyer ..... 241/36

6,308,904 B1 * 10/2001 Chang ..... 241/36

* cited by examiner

*Primary Examiner*—Faye Francis
(74) *Attorney, Agent, or Firm*—Pro-Techtor Int'l Services

(57) ABSTRACT

A paper shredder delaying device according to the present invention includes a pushing block installed by the paper feeding entrance inside of a top lid and the two conductors each screwed on one side of the pushing block. When papers are inserted into the paper feeding entrance, the aforesaid pushing block is pushed and thus oppresses the two conductors to conduct power and activates the electrical delaying device for the paper shredder to achieve delaying purpose.

2 Claims, 4 Drawing Sheets

PAPER SHREDDER DELAYING DEVICE

BACKGROUND OF THE INVENTION (a) Field of the Invention

The present invention relates to a paper shredder delaying device comprising a pushing block installed by a paper feeding entrance of a top lid. Furthermore, the pushing block is pressed by the papers to oppress the two conductors to be conducted for a paper shredder to achieve delaying purpose.

(b) Description of the Prior Art

Most of the conventional paper shredder delaying devices adopt sensorial electrical delaying devices, and short circuit is easily resulted from humidity and poor connection. Meanwhile, some paper shredders adopt the rolling wheels, the toothed-axles or other mechanisms as delaying shutdown devices; however, the delaying time of the mechanical delaying devices are limited, and consequently the delaying time of the paper shredders is not adjustable neither.

SUMMARY OF THE INVENTION

The primary object of the invention is to provide a paper shredder delaying device with a pushing block installed by a paper feeding entrance of a top lid. The paper shredder is delayed when the pushing block oppresses the two conductors to conduct and activates an electrical delaying device.

To better understand the invention, detailed descriptions of a preferred embodiment shall be given with the accompanying drawings below.

DETAILED DESCRIPTION OF THE PREFERRED EMBODIMENTS

Figure 1:
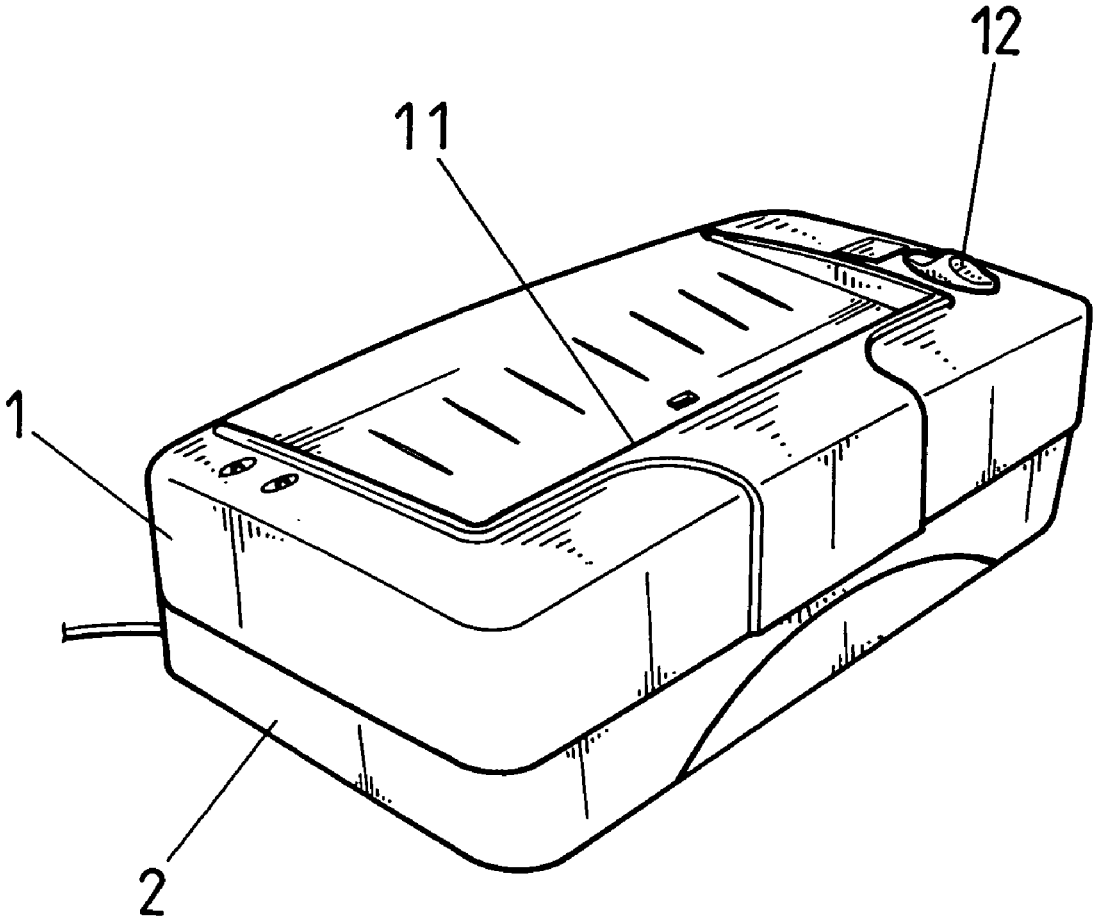
FIG. 1 shows an elevational schematic view of the invention.
Figure 2:
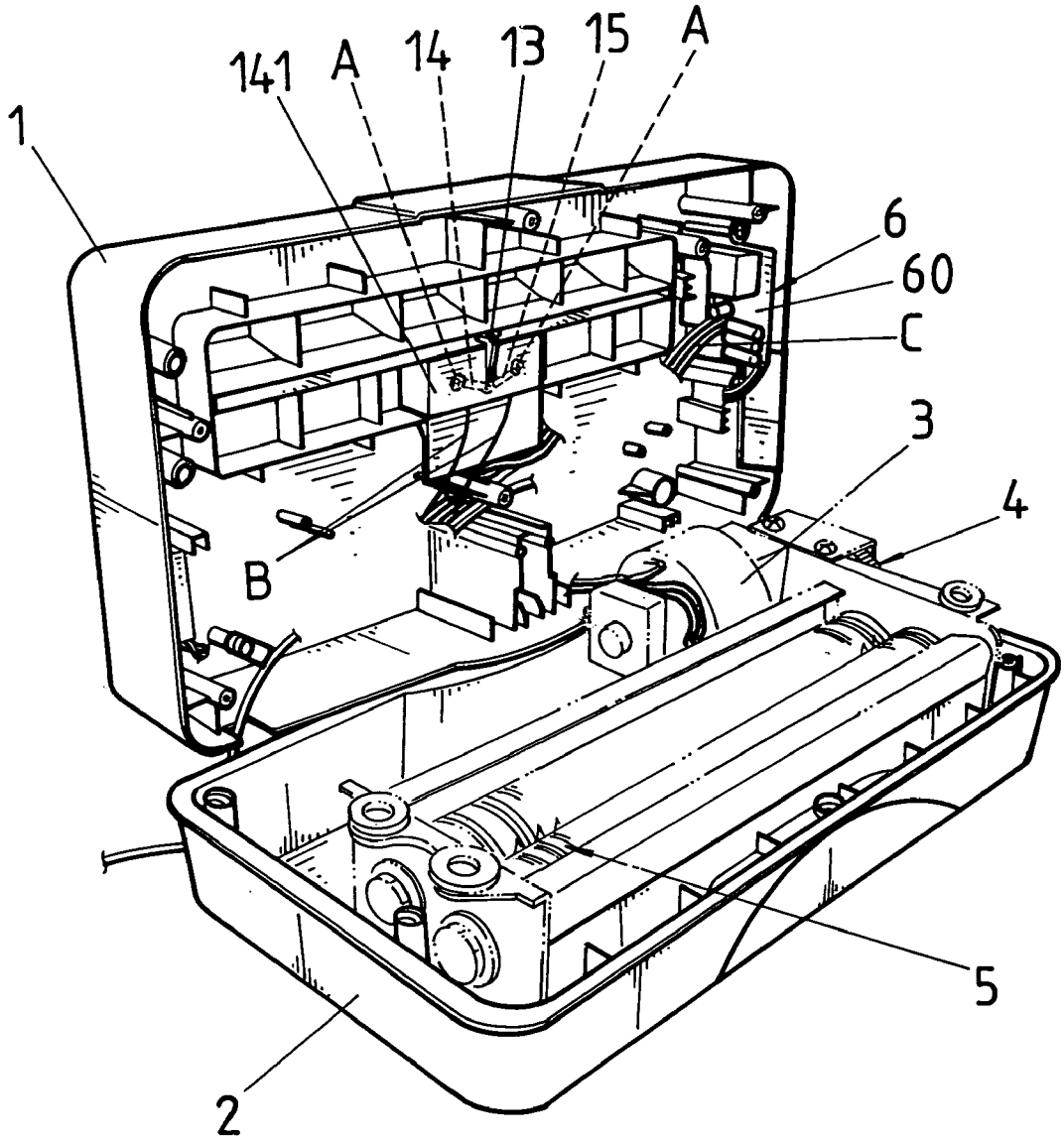
FIG. 2 shows a schematic view of the invention.

According to FIG. 1 and FIG. 2, a paper shredder delaying device consists of a top lid 1, a base 2, a motor 3, a decelerator 4 and a blade module 5. Wherein the top lid 1 is consisted of a paper feeding entrance 11 and a power switch 12, while the base 2 accommodates the motor 3, the decelerator 4 and the blade module 5. The decelerator 4 activated by the motor 3 drives the blade module 5 to rotate and shred papers.

Figure 3:
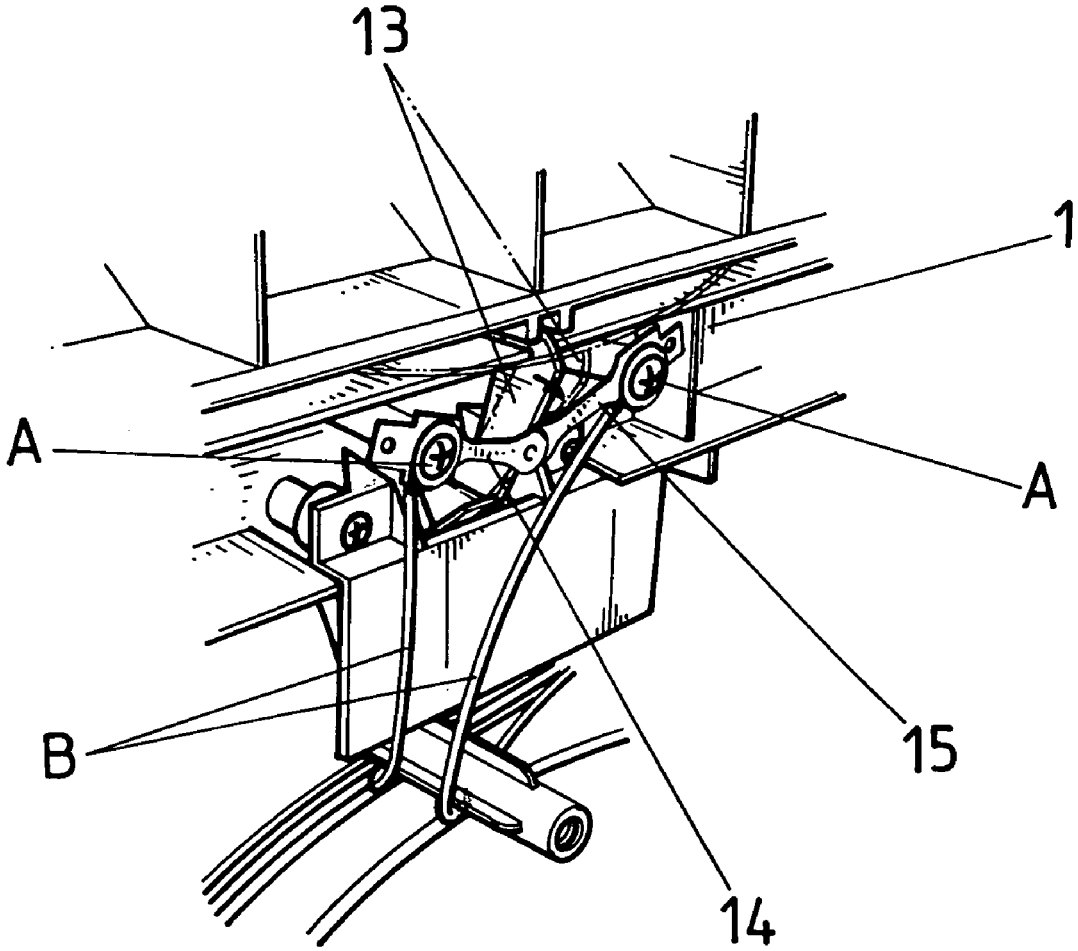
FIG. 3 shows a partial elevational view of the invention.
Figure 4:
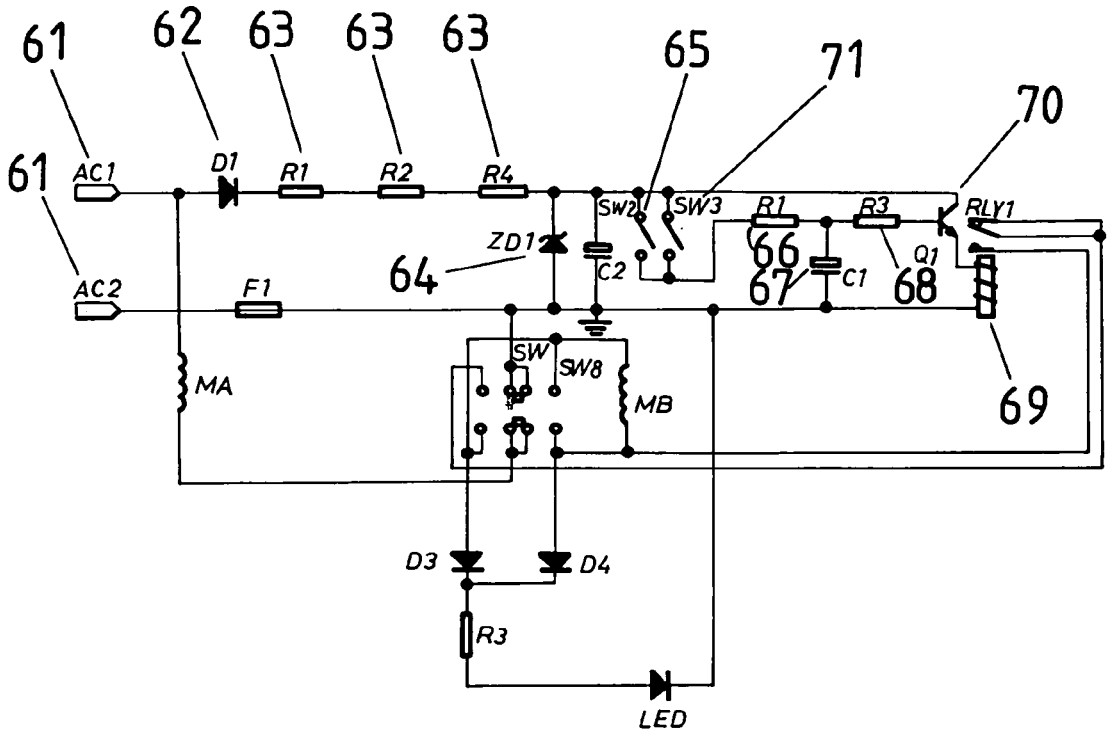
FIG. 4 shows a circuit diagram according to the invention.

The invention is characterized in that a pushing block 13 is installed by the paper feeding entrance 11 inside of the top lid 1, two conductors 14 and 15 each screwed on one side of the pushing block 13 by a bolt A, forming a normally-open electrical contact, the two conductors 14 and 15 are isolated and covered by a cover 141 as shown in FIG. 2. Referring to FIG. 3, when papers or CDs are inserted, the pushing block 13 is pushed downward and presses the two conductors 14 and 15 to conduct. The two conductors 14 and 15 are connected to an electrical delaying device 6 inside of the top lid 1 by the wires B respectively. The two connectors 61 (shown in FIG. 4) are configured on a PC board 60 (shown in FIG. 2) to connect with the two conductors 14 and 15, and the PC board 60 comprises a rectifying circuit, a regulating circuit, and a time-delay circuit; which, in one embodiment, comprise a rectification diode 62, a trisected electric resistance 63, a regulated diode 64, a wave filtered capacitance 65, a recharging resistance 66, a delaying capacitance 67, a radiating resistance 68, a relay 69, a power supplying tube 70 for the relay 69 and a touching switch 71 for insertion of papers or CDs. When the two conductors 14 and 15 are connected and conducted by the touching switch 71 during paper or CD insertion, they recharge the wave filtering capacitance 65 through the recharging resistance 66, discharge through the radiating resistance 68 offering the power supplying tube 70 with conduction for the relay 69 and supply power to the motor. After the paper or CD insertion, the sensor switch 71 bounces and discharges electricity through the delaying capacitance 67 to delay shutdown.

The delaying time of the electrical delaying device 6 according to the invention may be adjusted from 0 to 10 seconds according to user's preference.

In the view of the above, the present invention achieves 0 to 10 seconds of delaying time for the paper shredders by oppressing the two conductors to conduct with a pushing block installed inside of a paper feeding entrance.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A paper shredder delaying device comprising:

a top lid having a paper feeding entrance, a power switch, a pushing block, installed by the paper feeding entrance inside of the top lid, with two conductors forming an electrical contact, and an electrical delaying device having a PC board electrical circuit with a rectifing circuit, a regulating circuit, and a time-delay circuit; and a base containing a motor, driving a decelerator, and a blade module, driven by the decelerator to rotate;

wherein the two conductors of the electrical contact, which is normally open, are closed by the pushing block when it is pressed downward during paper insertion through the paper feeding entrance, thereby activating the electrical delaying device to delay the shutoff of the paper shredder.

2. A paper shredder delaying device comprising:

a top lid having a paper feeding entrance, a power switch, a pushing block, installed by the paper feeding entrance inside of the top lid, with an electrical contact comprising two conductors, and an electrical delaying device having a PC board electrical circuit; and a base containing a motor, driving a decelerator, and a blade module, driven by the decelerator to rotate;

wherein the two conductors of the electrical contact, which is normally open, are closed by the pushing block when it is pressed downward during paper insertion through the paper feeding entrance, thereby activating the electrical delaying device; and wherein the electrical delaying device installed inside of the top lid has a PC board with two connectors connected with the two conductors, a rectifying diode, a trisecting current resistance, a regulating diode, a wave filtering capacitance, a recharging resistance, a delaying capacitance, a discharging resistance, a relay, a power supplying tube for the relay, and a touching switch that when conducting, recharges the wave filtered capacitance through the rechargeable resistance, which discharges through the discharging resistance allowing the power supplying tube to conduct through the relay thereby supplying power to the motor during paper insertion, and after paper insertion the sensor switch bounces back and discharges through the delaying capacitance to delay the motor shut-off after the end of paper insertion.

* * * * *